United States Patent [19]

Nyssen et al.

[11] Patent Number: 5,075,161

[45] Date of Patent: Dec. 24, 1991

[54] EXTREMELY FINE POLYPHENYLENE SULPHIDE FIBRES

[75] Inventors: Peter R. Nyssen; Wolfram Wagner, both of Dormagen, Fed. Rep. of Germany

[73] Assignee: Bayer Aktiengesellschaft, Leverkusen, Fed. Rep. of Germany

[21] Appl. No.: 326,960

[22] Filed: Mar. 22, 1989

[30] Foreign Application Priority Data

Mar. 29, 1988 [DE] Fed. Rep. of Germany ..... 3810596

[51] Int. Cl.[5] ..... D04H 1/58; D04H 1/04; D02G 3/00; B29C 47/88

[52] U.S. Cl. ..... 428/288; 264/14; 264/211.12; 264/211.13; 264/211.14; 428/293; 428/296; 428/373; 428/903

[58] Field of Search ..... 428/113, 288, 296, 224; 264/14, 8, 211.12, 211.14; 252/500

[56] References Cited

U.S. PATENT DOCUMENTS

| | | | |
|---|---|---|---|
| 4,048,364 | 9/1977 | Harding et al. | 428/113 |
| 4,380,570 | 4/1983 | Schwarz | 428/296 |
| 4,399,084 | 8/1983 | Sagawa et al. | 264/27 |
| 4,454,189 | 6/1984 | Fukata | 428/224 |
| 4,772,421 | 9/1988 | Ikenaga et al. | 252/500 |
| 4,937,020 | 6/1990 | Wagner et al. | 264/8 |

*Primary Examiner*—George F. Lesmes
*Assistant Examiner*—James D. Withers
*Attorney, Agent, or Firm*—Sprung Horn Kramer & Woods

[57] ABSTRACT

Fibres, fibre webs or fibre aggregates made of polyphenylene sulphide (PPS) or of mixtures of PPS with other polymers are produced by a melt-spinning process where the melt filaments are drawn out and cooled down to below the melt temperature by a gaseous medium flowing essentially parallel thereto at sonic or supersonic speed, this simultaneous deformation and cooling giving rise to amorphous fine or extremely fine fibres (17) of finite length which are deposited to form a fibre web or fibre aggregate.

8 Claims, 2 Drawing Sheets

EXTREMELY FINE POLYPHENYLENE SULPHIDE FIBRES

Figure 1:
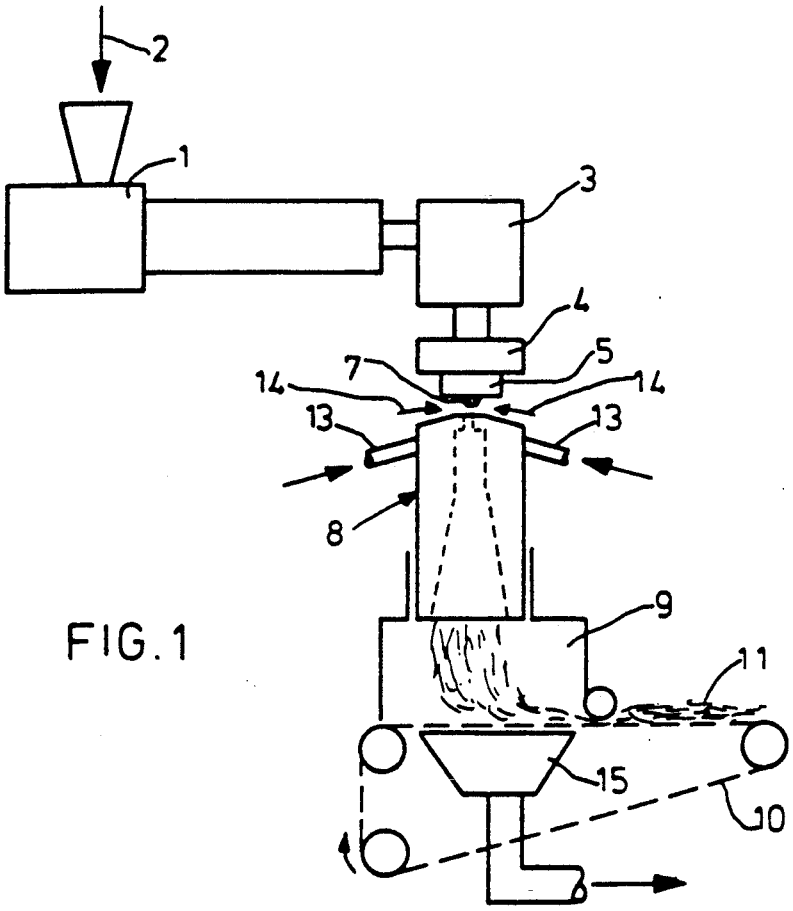

The invention relates to fibres, fibre webs or fibre aggregates based on polyphenylene sulphide and processes for producing such products.

The production of polyphenylene sulphide fibres (PPS fibres) by spinning from a PPS melt is known. According to EP 171,021, polyarylene sulphides which are members of the group of polyphenylene sulphide are meltspun into fibres and filaments.

Hitherto, however, no fibre webs or fibre aggregates consisting of extremely fine polyphenylene sulphide fibres of finite length have been disclosed. Fibre structures of this type can as is known be further processed into mats or sheeting and have manifold applications.

On working with PPS melts it has been found that such melts tend to oxidize at the surface, thereby impairing the quality of the melt-spun fibres.

This problem is all the more serious the finer the fibres are, i.e. the higher the ratio of surface area to volume.

This is the starting point for the invention. It is an object of the present invention to produce webs or aggregates consisting of fine or extremely fine fibres of high quality on the basis of pure polyphenylene sulphide or mixtures of polyphenylene sulphide with other polymers (PPS polyblends) by specific further processing of the polymer melt streams emerging from a spinning nozzle. And in the course of production the above-mentioned impairment of fibre quality due to surface oxidation shall be eliminated as far as possible.

This object is achieved according to the invention when PPS-based polymer fibres having an average fibre diameter $<6$ μm, preferable 0.2 μm to 6 μm, are produced by subjecting the polymer melt streams to drawing out and cooling to below the melt temperature by extruding them into a gaseous medium which flows essentially parallel to the polymer melt streams and which attains sonic or supersonic speed along a zone of 2 mm to 100 mm, preferably 2 mm to 50 mm, and at a lateral distance of 2 mm to 30 mm from the exit openings, this simultaneous deformation and cooling giving rise to amorphous fine or extremely fine fibres of finite length which are deposited to form a fibre web or fibre aggregate.

In a variant for producing such fibres, the melt streams are additionally drawn out by the action of a static pressure gradient acting on the melt streams essentially along a zone of 1 mm to 30 mm, preferably 2 mm to 10 mm, downstream of the exit openings. The fibre formation process here thus involves on the one hand a direct pressure gradient and on the other an acceleration by a parallel-flowing gaseous medium.

Fibres of high product quality can be obtained in an advantageous manner if melts having a spinning viscosity of 2 Pas to 250 Pas, preferably 80 Pas to 150 Pas, and a melt temperature of $T_S=310°$ C. are used.

It has been found that the PPS-based fibres thus produced conform to a narrow Gaussian distribution having a coefficient of variation of $<50\%$, preferably between 10% and 35%, and without heat setting have a strength of 0.4 to 1.1 GPa and an elongation of 20 to 80% and after heat setting under tension have a strength of 0.6 to 1.1 GPa and an elongation of 10% to 30%. The process for producing such PPS fibres is characterized according to the invention in that PPS-based polymer melt streams emerging from spinning holes are drawn out to form fine fibres of finite length and cooled down below the melt temperature by the action of an inert gas flowing parallel thereto at a temperature of 20° C. to 280° C., preferably 80° C. to 200° C.

Conveniently, the action of the hot inert gases brings about a heat setting of the fibres immediately following the fibre formation process.

Alternatively, the fibres emerging from the draw nozzle can be subsequently subjected to a heat setting by means of a calender or by means of inert gases at a tempperature of 80° C. to 260° C., preferably being heat set in multiple stages.

Furthermore, it has been found that fibres or fibre aggregates of particularly low shrinkage can be produced if the starting material used for the polymer melt comprises mixtures of PPS (PPS polyblends) and polybutylene terephtalate in a mixing ratio of 2:1 to 10:1, preferably 4:1 to 8:1.

The new PPS fibres are superior to the known PPS fibres in mechanical properties. They have in particular a higher breaking strength. These favourable properties are probably due to the fact that oxidation processes during spinning can be largely avoided owing to the high rate of cooling in the draw nozzle.

Figure 2:
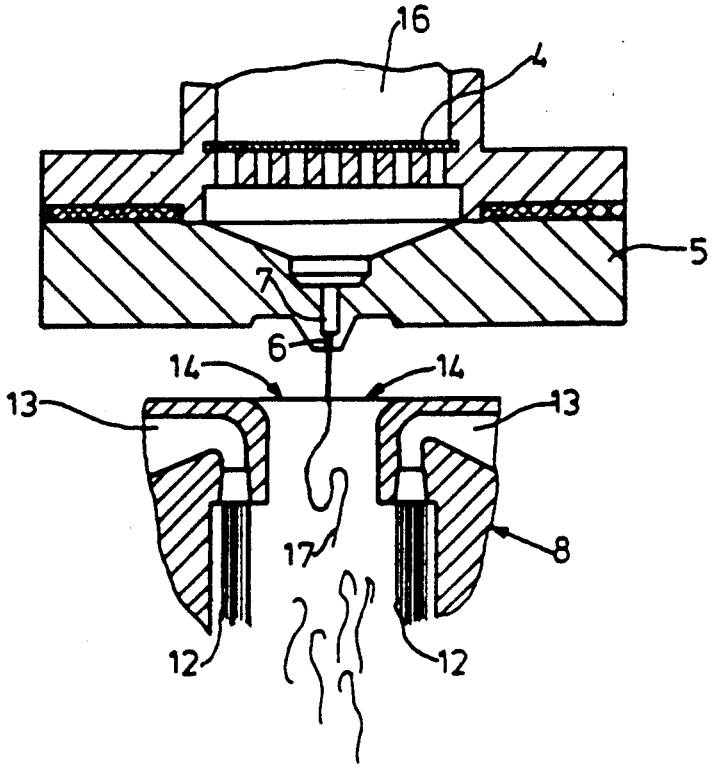
Figure 3:
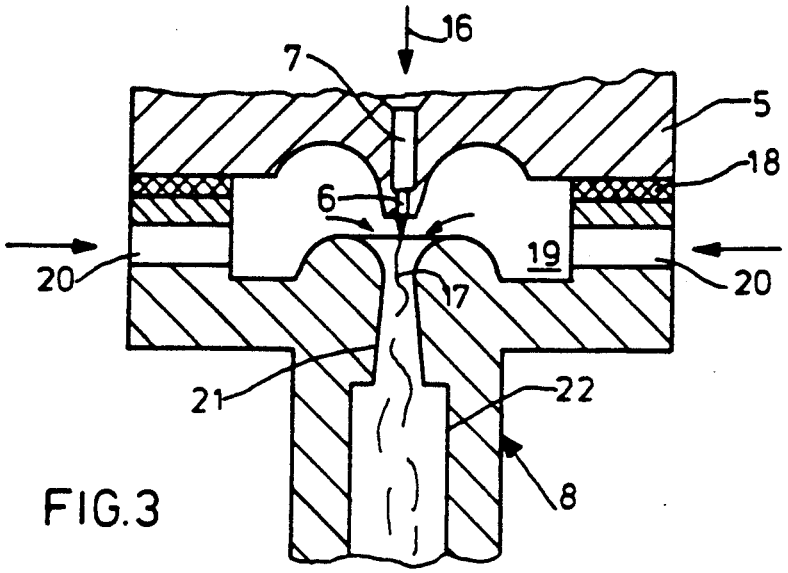
Figure 4:
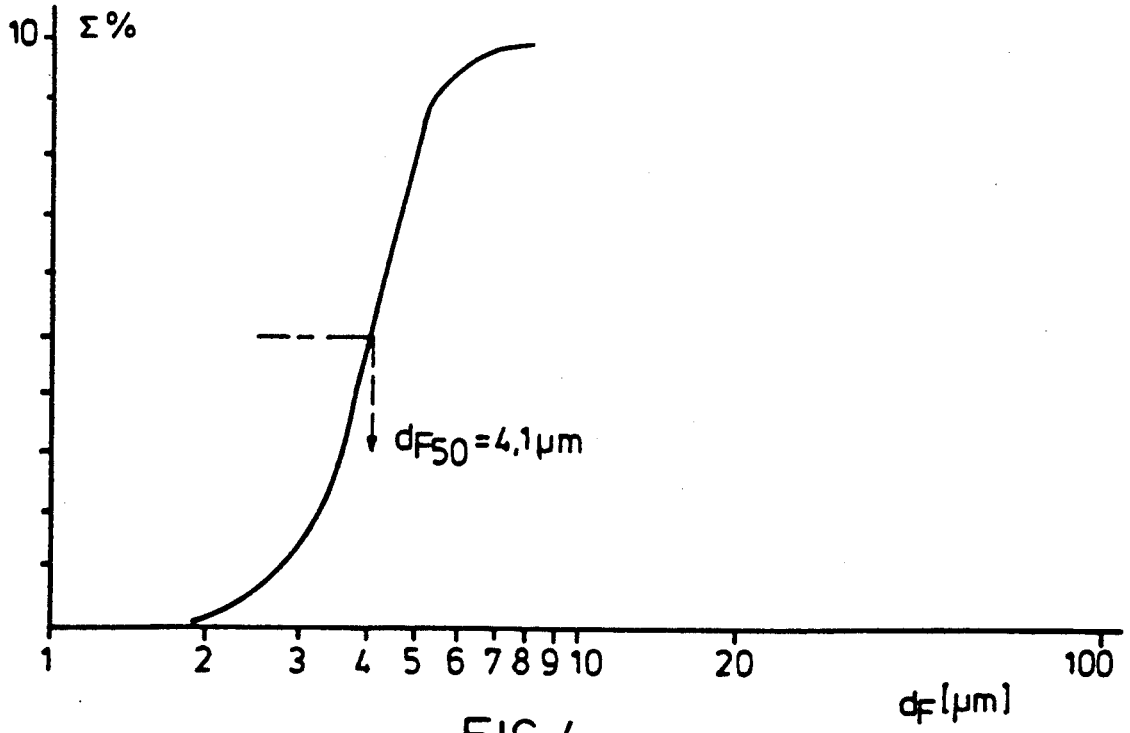

In what follows, the invention is illustrated by reference to drawings and working examples, where FIG. 1 shows a process scheme for producing extremely fine PPS fibres by the draw nozzle process, FIG. 2 shows the spinning nozzle and the draw nozzle inlet, FIG. 3 shows an apparatus where fibre formation takes place by means of a static pressure gradient and acceleration by a gas stream, and FIG. 4 shows a typical fibre diameter distribution for the new extremely fine PPS fibres.

EXAMPLE 1

In accordance with FIG. 1, the extruder 1 melts PPS granules 2 at a temperature of 320° C. and the melt is transported by the spinning pump 3 through the melt filter 4 to the spinning nozzle 5 under a pressure of 6 bar. The melt has at that temperature a viscosity of 50 Pas. From the exit openings 6 of the spinning teat 7 (FIG. 2 and FIG. 3) the emerging melt 8 is drawn out in the gas-dynamic draw nozzle 8 disposed underneath the spinning nozzle 5 to give extremely fine fibres which are deposited in the collection chamber 9 on a conveyor belt 10 to form a fibre web 11. A detailed description of the construction and functioning of the draw nozzle 8 can be found for example in EP 38,989 and EP 66,506. The fibrillation and draw-out effect in the draw nozzle 8 is brought about by a pressure gradient along the axis of the draw nozzle which is produced in a known manner by propulsive jets 12 (FIG. 2). The propellant here comprises compressed air at a temperature of 50°–100° C. under a static pressure of 10 bar, supplied by the connections 13. Owing to the pressure gradient, atmospheric air 14 is sucked in at the draw nozzle at a temperature of 20° C. to 30° C. Propellant and suction gas are aspirated away underneath the collection chamber 9 and conveyor belt 11 by the suction box 15.

The temperature of the spinning nozzle 5 is kept at a constant value within the range from 300° C. to 350° C. The mass throughput per spinning hole is 2.5 g/min.

The resulting fibres 11 have the fibre diameter distribution depicted in FIG. 4 with an average fibre diameter of 4.1 μm and a coefficient of variation of 33%.

In the diagram of FIG. 4 the ordinate is the cumulative frequency of all occurring fibre diameters which are each below a fibre diameter limit plotted as the abcissa. It can be seen that fibres having a diameter <2 μm and >8 μm virtually no longer occur.

EXAMPLE 2

Using the same apparatus (FIG. 1 and FIG. 2), except that nitrogen at a temperature of 150° C. is used as the suction gas 14, the melt filaments are fibrillated and drawn out under otherwise the same conditions into extremely fine fibres having a diameter of 1.5 μm with a standard deviation of 0.6 μm which in turn were deposited as a web 11 on the conveyor belt 10. The web thus produced is notable for being shrinkage-free.

EXAMPLE 3

The same apparatus as before was used under the same conditions as in Example 1 to produce a fibre web which, following fibre deposition, was subjected to a heat setting with a hot inert gas. In the course of this heat setting, the web was exposed to temperatures of from 80° C. to 260° C. in zones. These measures were likewise applied to prevent shrinkage of the material.

EXAMPLE 4

The draw nozzle process employed in the above-described working examples can also be modified by initially fibrillating the melt stream by means of a high static pressure gradient and thereafter drawing it out again with a parallel-flowing gas stream (see FIG. 3). For this purpose the spinning nozzle 5 combines with the downstream draw nozzle 8 to form a closed system. The melt 16 is supplied as in the arrangement of FIG. 2 via a melt filter to the spinning teat 7 with the exit opening 6. In contradistinction from the apparatus of FIG. 2, however, there is arranged between the bottom edge of the spinning nozzle 5 and the top edge of the draw nozzle 8 a sealed-off (18) closed pressure space 19 which is rotationally symmetrical about the axis. The pressure space, which is enclosed on all sides, can be supplied with pressurized inert gas via the holes 20.

For instance, the inert pressurized gas was introduced into the pressure space 19 at a temperature of 350° C. under an absolute pressure of 10 bar. Fibre formation 17 then takes place directly within the pressure gradient and also, owing to the gas stream resulting from the pressure gradient (maximum pressure in the pressure space 19), within the Laval nozzle 21 following the pressure space and within the downstream shock diffuser 22. The deposition of the fibres 17 to form the web 11 takes place in the same way as in the apparatus for FIGS. 1 and 2. Under the operating conditions described above this variant produced extremely fine fibres having an average fibre diameter of 0.6 μm and a standard deviation of 0.4 μm.

A further process variant for producing the PPS fibres according to the invention consists in blasting the melt streams emerging from the spinning nozzle in an adjoining open space (free space) with high-speed hot air essentially in the direction of flow. In this case it is thus possible to dispense with the draw nozzle or Laval nozzle following the spinning nozzle. The process is known as melt blowing and is described in detail for example in U.S. Pat. No. 4,048,364. It is suitable in particular for processing low-viscosity melts.

The starting material used in all cases was polyphenylene sulphide in the form of granules. A particularly suitable subgroup of the polyphenylene sulphides are the polyarylene sulphides whose production and properties are described in more detail in EP 171,021.

We claim:

1. Fibres, fibre webs or fibre aggregates made of polyphenylene sulphide (PPS), or of mixtures of PPS with polybutylene terephthalate which are obtained by further processing the polymer melt streams emerging from a spinning nozzle having at least one hole 0.05 mm to 2 mm in diameter, the fibres having an average fibre diameter of <6 μm and having been produced by subjecting the polymer melt streams to drawing out and cooling to below the melt temperature by extruding them into a gaseous medium which flows essentially parallel to the melt streams and which attains sonic or supersonic speed along a zone of 2 mm to 100 mm, the melt streams having been additionally drawn out by the action of a static pressure gradient acting on the melt streams along a zone of 1 mm to 30 mm downstream of the exit openings, this simultaneous deformation and cooling giving rise to amorphous fine or extremely fine fibres of finite length which are deposited to form a fibre web or fibre aggregate.

2. Fibres, fibre webs or fibre aggregates according to claim 1, wherein the fibres are produced from melts having a spinning viscosity of 2 Pas to 250 Pas at a melt temperature of $T_s$=310° C.

3. Fibres, fibre webs or fibre aggregates according to claim 1, wherein the fibre diameter distribution conforms to a narrow Gaussian distribution having a coefficient of variation <50% and without heat setting the fibres have a strength of 0.4 to 1.1 GPa and an elongation of 20% to 80% and after heat setting under tension the fibres have a strength of 0.6 GPa to 1.1 GPa and an elongation of 10% to 30%.

4. Fibres, fibre webs or fibre aggregates according to claim 1, wherein the fibres are extruded into a hot inert gas whereby a heat setting of the fibres is effected immediately following the fibre formation process.

5. Fibres, fibre webs or fibre aggregates according to claim 1, wherein the fibres are subjected to a heat setting by means of a calendar.

6. Fibres, fibre webs or fibre aggregates according to claim 1, wherein the fibres are subjected to a heat setting by means of inert gases at a temperature of 80° C. to 260° C.

7. Fibres, fibre webs or fibre aggregates according to claim 1, wherein the starting material used for the polymer melt comprises a mixture of PPS and polybutylene terephthalate in a mixing ratio of 2:1 to 10:1.

8. Fibres, fibre webs or fibre aggregates according to claim 1, wherein the fibres have an average diameter of 0.2 μm to 6 μm, the zone along which the gaseous medium attains sonic or supersonic velocity is from 2 mm to 50 mm and the zone along which the static pressure gradient acts on the melt streams is from 2 mm to 10 mm.

* * * * *